United States Patent [19]

Carlsson et al.

[11] Patent Number: 4,986,058

[45] Date of Patent: Jan. 22, 1991

[54] PRESSURE APPLICATION ARRANGEMENT ON A PACKING MACHINE

[75] Inventors: Lars C. Carlsson, Blentarp; Vilnis Bruveris, Malmö, both of Sweden

[73] Assignee: AB Tetra Pak, Lund, Sweden

[21] Appl. No.: 38,982

[22] Filed: Apr. 16, 1987

[30] Foreign Application Priority Data

Apr. 18, 1986 [SE] Sweden ..... 8601781

[51] Int. Cl.[5] ..... B65B 51/10

[52] U.S. Cl. ..... 53/563; 53/387; 53/565; 493/141

[58] Field of Search ..... 53/563, 565, 276, 272, 53/234, 388, 387; 493/183, 184, 141, 133, 156, 308

[56] References Cited

U.S. PATENT DOCUMENTS 3,486,423 12/1969 Mistarz ..... 53/565 X 3,619,979 11/1971 Martensson et al. ..... 53/565

FOREIGN PATENT DOCUMENTS 361022 10/1973 Sweden .

*Primary Examiner*—James F. Coan

*Attorney, Agent, or Firm*—Burns, Doane, Swecker & Mathis

[57] ABSTRACT

Packing machines which manufacture packing containers of the so-called gable-top type from flexible packing laminate frequently handle prefabricated, tubular packing container blanks which are provided with a bottom section by folding in and sealing of a number of bottom wall panels. The bottom is pressed down and sealed while the blank is supported by a mandrel on a mandrel wheel.

In order to avoid the transmission of the pressing and sealing forces to, and stressing of, the axle and bearing of the mandrel wheel, an arrangement is proposed which is designed so that the compressive forces generated by the pressure devices are absorbed by a tie rod which connects the pressure application arrangement with the axle of the mandrel wheel, so that the forces are absorbed internally without stressing the mandrel wheel axle or other surrounding elements.

11 Claims, 3 Drawing Sheets

PRESSURE APPLICATION ARRANGEMENT ON A PACKING MACHINE

BACKGROUND OF THE INVENTION

The present invention relates to an arrangement for the application of pressure on a packing machine which comprises a stepwise rotatable mandrel wheel with radial mandrels for supporting and positioning of packing container blanks to form the bottom portion of containers made from the blanks.

Packing containers of the so-called gable-top type are used at present as non-returnable packages for a number of produces, above all liquid foods such as milk or juice. The packing containers are manufactured from a foldable, semi-rigid packing laminate which generally comprises a carrier layer of fibrous material, coated on both sides with thermoplastic material which on the one hand provides good liquid-tightness, and on the other hand makes possible hot-sealing of the packing laminate. The packing laminate is divided into individual sheets which by means of a longitudinal, liquid-tight seal are converted to tubular blanks of substantial square cross-section. The blanks are provided with suitable crease lines so as to delimit wall panels for the side walls as well as top and bottom wall panels which by means of folding and sealing can be converted to a liquid-tight top and bottom respectively. This conversion of the tubular blanks takes place, like the filling with contents, in a packing machine where the tubular blanks are provided with a bottom by the folding of bottom wall panels along the crease lines and sealing the panel so as to form a plane bottom. As result, the blanks are given a fillable from and the desired quantity of contents can be introduced. After the filling the top of the packing container is formed by folding of the top wall panels and subsequent hot-sealing. A packing machine of this type is shown in Swedish patent no. 361.857.

In the manufacture of packing containers in a machine of the aforementioned type the forming and sealing of the bottom of the packing container blank generally are carried out in the following manner: The tubular blank is placed on a mandrel of square cross-section and is maintained in such a position that the bottom folding panels located at the bottom end of the blank extend outside or beyond the free end of the mandrel. The mandrel is arranged, together with a number of mandrels of the same sort, radially on a mandrel wheel which is stepwise rotatable so that a blank placed on a mandrel can be moved between different processing stations. After a blank has been placed on a mandrel while the mandrel is in a loading station, the mandrel wheel is turned so that the actual mandrel with the blank stops in a heating station where a hot-air furnace or some other suitable heating device heats the thermoplastic layer on the parts of the packing container blank which extend outside or beyond the mandrel end and are to be sealed to one another so as to form the bottom when the heating the mandrel and the blank are moved to a sealing station. During this movement a successive folding of the bottom folding panels takes place, so that the panels partly overlap one another and form a plane bottom. The bottom is pressed down and is sealed with the help of pressure devices which are displaceable so that they can be pressed with a predefined force against the bottom wall panels and the mandrel end lying or positioned behind the bottom. Since the total surface of the bottom is relatively large, very high compressive forces arise in the sealing process, which brings about great stresses on the axle of the mandrel wheel as well as on its bearing arrangement in the machine frame. These machine components, therefore, have to be fairly largely dimensioned.

This, of course, is undesirable, and it is attempted in modern machine designs to distribute and reduce especially stresses on the bearing of the mandrel axle with the help of tie rods, arranged between the machine frame and the projecting part of the mandrel axle supporting the mandrel wheel. It is a disadvantage of such an arrangement that when the bottom portion of a container is pressed down a certain movement and oblique stressing cannot be wholly avoided, which makes necessary a flexible support of the pressure applying element. This is achieved with the help of rubber grommets which, however, impair the precision of the arrangement. The arrangement, moreover, is applicable only to those types of machines where the application of pressure is performed with the help of the sort of elements which do not require to be directly mechanically connected to the driving arrangement of the packing machine, that is to say piston and cylinder units of pneumatic or hydraulic type.

It is generally desirable that in a machine of the abovementioned type it should be possible to utilize a mechanical, cam-controlled pressure application, since this permits increased accuracy as well as higher operating speed. At the same time a reduction of the stress on the mandrel axle and its associated bearing is particularly desirable, especially if this can be achieved without oblique stress and without flexible suspension of the unit.

It is an object of the present invention to provide a pressure application arrangement for a packing machine with mandrel wheel, this arrangement being of a simple design, reliable function and long working life.

It is a further object of the present invention to provide an arrangement with mechanical pressure application, where the compressive forces arising, and the reactive force following thereupon, can be taken care of without the mandrel axle and its associated bearings being subjected to excessive stresses.

Finally, it is a further object of the present invention, to provide a pressure application arrangement which is of high precision, even during prolonged operation and lacks the disadvantages which similar, previously known, designs have been subject to.

These and other objects have been achieved in accordance with the invention in that an arrangement for the application of pressure on a packing machine which comprises a stepwise rotatable mandrel wheel with radial mandrels for the receiving, supporting and position of packing container blanks and the formation of containers having bottom portions from the blanks. The machine comprises an axle with eccentrically arranged portions, the axle being connected on the one hand to pressure devices so as to co-operate with the mandrels and on the other hand, to devices absorbing tensile forces which are connected to the mandrel wheel.

BRIEF DESCRIPTION OF THE DRAWINGS

A preferred embodiment of the arrangement in accordance with the invention will now be described in more detail with reference to the attached schematic drawings which only show the details indispensable for an understanding of the invention.

DETAILED DESCRIPTION OF A PREFERRED EMBODIMENT

Figure 1:
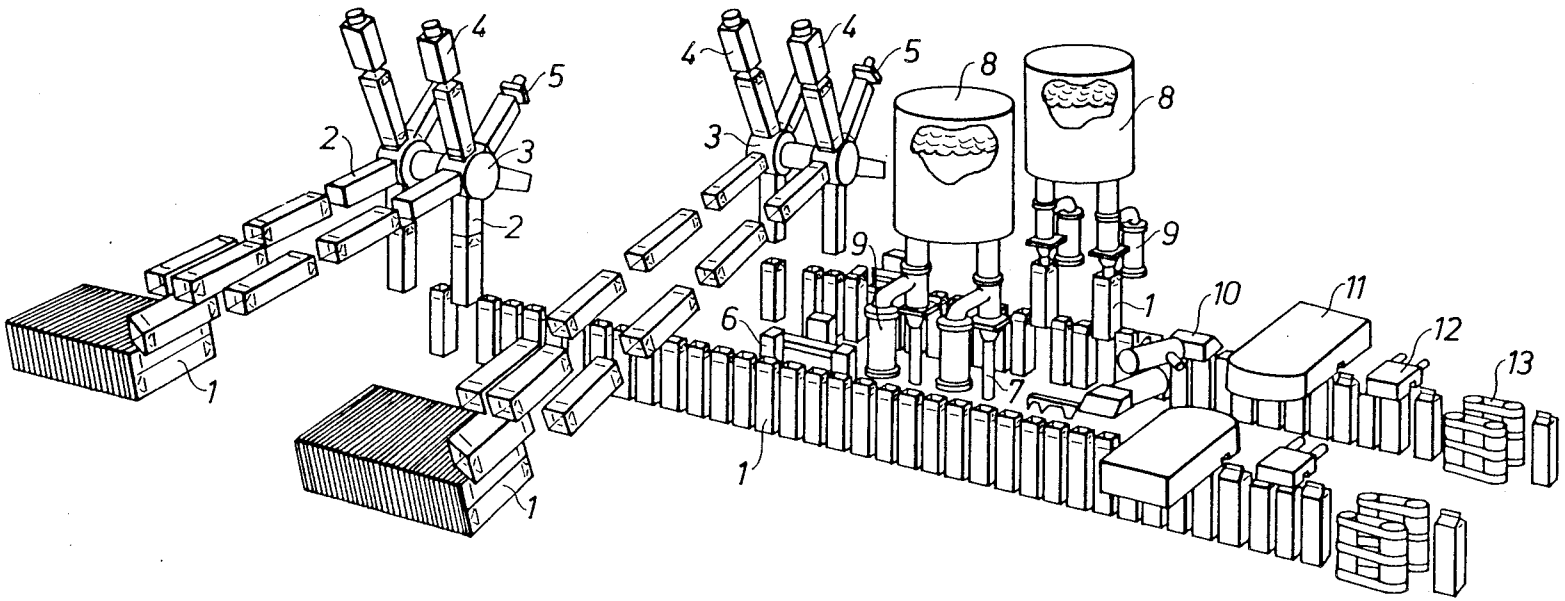
FIG. 1 shows stepwise the passage of packing container blanks through a machine of the type wherein the arrangement in accordance with the invention is used.

This arrangement in accordance with the invention is intended for the application of pressure during the forming and sealing of packing container bottoms of the type which comprises a number of panels separated by means of crease lines. The panels are folded together so that they partly overlap each other and are sealed with the help or assistance of heat and pressure. The arrangement is intended first and foremost to be used on a machine of the principal type as illustrated in Swedish patent no. 361.857, to which reference is made. This type of packing machine is fed with, or converts a material web fed to the packing machine into tubular, flattened blanks 1 (FIG. 1) which are manufactured from a flexible packing laminate comprising a relatively rigid carrier layer of e.g. paper which is coated on both sides with thermoplastic, liquid-tight and sealable material. The blanks are provided with a number of crease lines so as to be divided in a known manner into side wall panels and bottom and top wall panels. On being fed from the magazine the blanks are raised from a collapsed state so that they obtain a substantially square cross-sectional shape, whereupon they are transported in their longitudinal direction and are applied onto a mandrel 2 corresponding to the raised shape of the blank on a mandrel wheel 3. The mandrel wheel can be single or double wheel and every machine may comprise one or more mandrel wheels. When the blank has been applied to a mandrel the mandrel wheel is turned or indexed on step or increment so that the bottom folding panels of the blank projecting outside the free end of the mandrel can be heated by means of a furnace or heater 4 which, preferably with the help of hot air, heats the thermoplastic material layers of the bottom wall panels to a softening temperature, which is suitable for sealing. On continued stepwise turning or indexing of the mandrel wheel 3 a folding of the heated bottom wall panels takes place so that the bottom wall panels overlap one another and form a substantially plane bottom, which in subsequent processing stations with the help of pressure devices 5 is pressed together and cooled so that the panels are sealed to one another in a water-tight manner. After further turning of the mandrel wheel 3 the liquid-tight blank provided with the bottom portion now sealed, can be drawn vertically downwards to a conveyor which transports the blank further in a longitudinal direction of the machine. The blank, during the conveying, will pass in order a top prefolder 6 which will prefold the top wall panels slightly so as to facilitate the subsequent top closure. Thereafter the blank is placed underneath a filler pipe 7, through which, from a contents tank 8, contents are passed with the help of a pump 9 in the desired quantity into the packing container. The packing container then continues to a stop in subsequent stations where a top furnace or heater 10, of the hot-air type, heats the top wall panels of the packing container so that the thermoplastic layers acquire an appropriate sealing temperature. The sealing of the top end of the packing container takes place with the help of top sealer 11, whereupon the filled and closed packing container via dating devices 12 and feed-out conveyors 13 is discharged from the packing machine in finished condition. This type of machine, just as the said processing stations, may be conventional and is not, therefore, described in any further detail.

Figure 2:
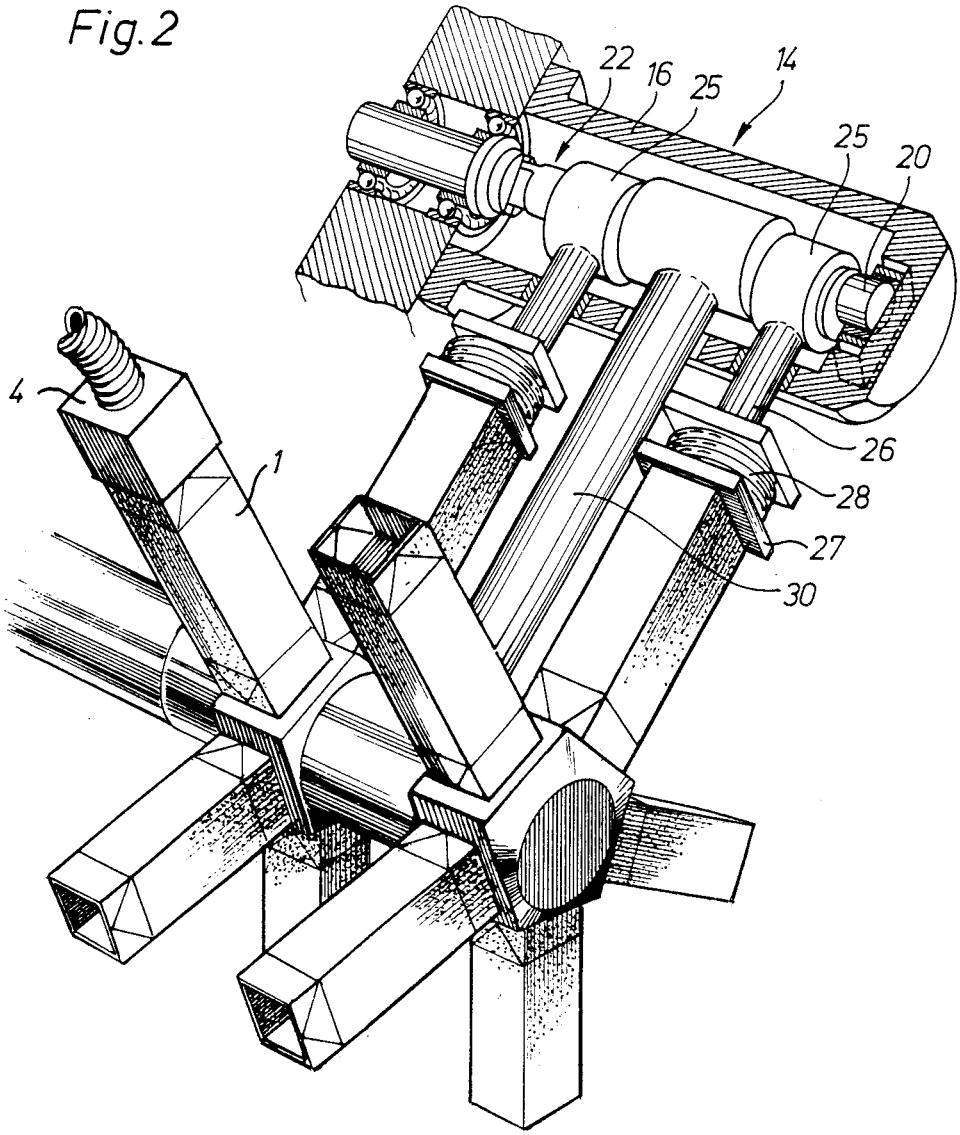
FIG. 2 shows the arrangement in accordance with the invention from the side and partly in section on a mandrel wheel with packing container blanks in the different processing stations.
Figure 3:
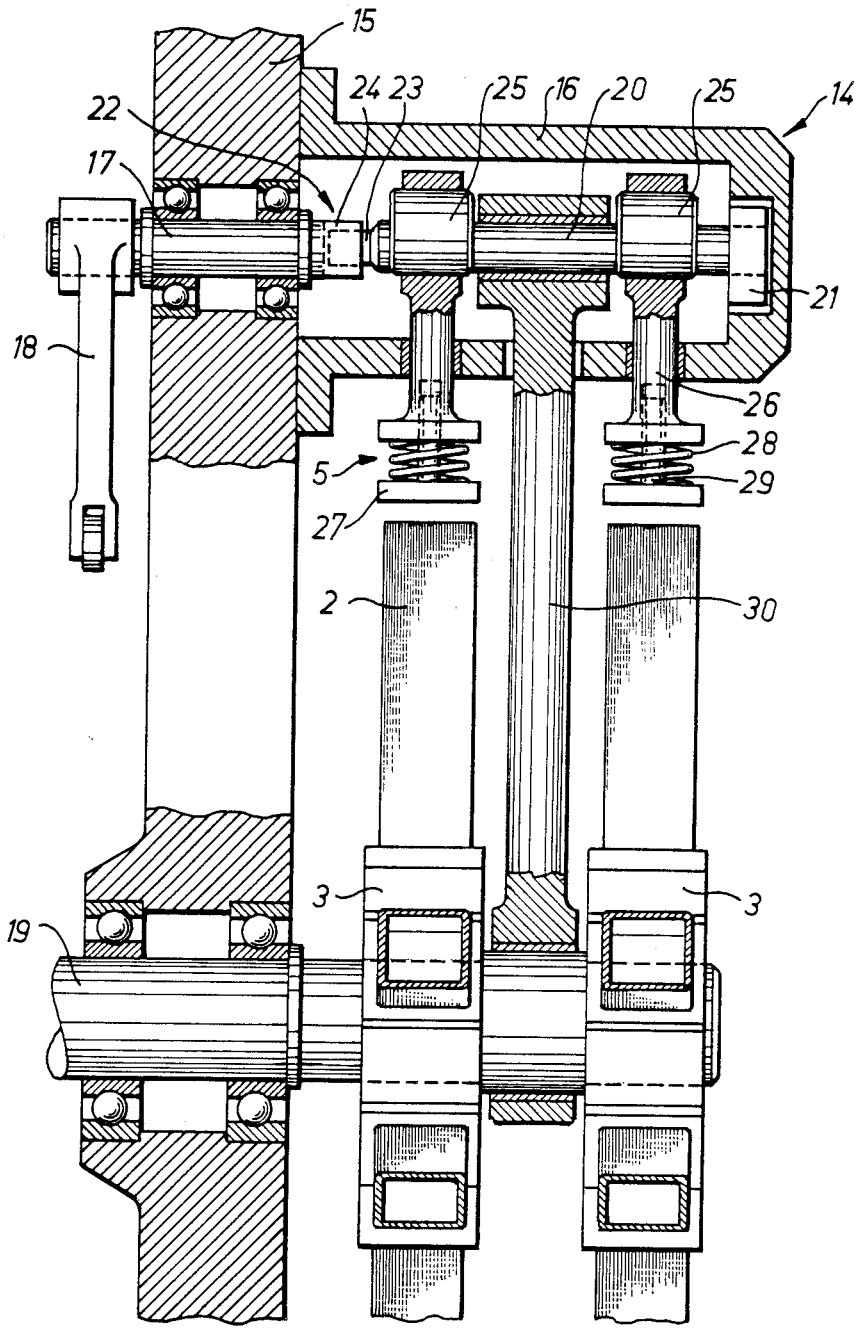
FIG. 3 shows the arrangement in accordance with the invention from the side and partly in section.

The arrangement in accordance with the invention, which is placed on the pressing stations of the mandrel wheel 3, is illustrated in more detail in FIGS. 2 and 3. The pressing arrangement 14 is located slightly outside the area of rotation or radially outwardly of the diameter of rotation of the mandrel wheel 3 and is supported by means of a bracket 16 projecting from the machine frame 15. The machine frame 15 also carries a driving shaft 17, supported so that is can rotate, for the pressure application arrangement 14. The driving shaft 17 comprising at its inner end, located in the frame 15, a lever arm 18 which is connected directly or indirectly to a cam (not shown) driven from the main shaft of the machine. The frame 15 also carries the mandrel wheel axis 19 of the mandrel wheel 3 which is also connected by means of known motion transfer elements to the main driving shaft of the packing machine in such a manner that during the operation of the machine it performs a stepwise rotating movement.

In the bracket 16 projecting from the machine frame 15 is located an eccentric shaft 20 which is mounted in an overhung manner, i.e., one end of mounted rotatably in a bushing 21 which is mounted so that it can slide in the bracket 16, while the opposite end of the shaft 20 is connected via a flexible coupling 22 to the driving shaft 17. The flexible coupling 22 comprises a tongue 23 projecting from the end of the eccentric shaft 20, which engages in a slidable manner in a groove 24 in the end surface of the driving shaft 17. The groove 24 is located so that in the active position of the arrangement it is substantially in the plane which connects the axis of rotation of the mandrel wheel 3 (that is to say the center axis of the mandrel wheel axle 19) to the center axis of the eccentric shaft 20. The eccentric shaft 20 will be slightly movable in this plane during the operation of the machine.

Between both end parts of the eccentric shaft 20 are provided two eccentric components or eccentrics 25 which are arranged at some distance from each other along the eccentric shaft 20. The two eccentrics 25 support the two pressure devices 5, each of which comprises a pressure shaft 26 which at its one end is mounted rotatably on the eccentric 25. The pressure shaft 26 extends through an opening in the side of the bracket 16 facing towards the mandrel wheel shaft 19 and supports on its opposite end a pressure plate 27 which by means of guiding elements 29 is connected to the pressure shaft 26, but is held at a distance from the same by a predefined force, with the help of spring elements 28 in the form of a precompressed, helical compression springs. In the inactive position of the arrangement shown in FIG. 3 the pressure plates 27 are at some distance from the end surfaces of the mandrels 2 and axially in line with the mandrels when the mandrel wheel 3 is in standstill or stationary position with the mandrels 2 indexed to the container bottom pressing station of the mandrel wheel.

Between the two pressure devices 5 there is a tie rod 30 which links the eccentric shaft 20 and the mandrel wheel axle 19. The upper end of the tie rod, more particularly, is mounted rotatably around the centre portion of the eccentric shaft 20, that is to say the part of the shaft 20 which is between the two eccentrics 25. The tie rod extends out of the bracket 16 and its other end is mounted rotatably around the mandrel wheel axle 19 between the two mandrel wheels 3. The mounting of the tie rod 30 on the mandrel wheel axle has maximum play of 1 mm which will be explained in more detail in the following. The two ends of the tie rod 30 are mounted on the respective axle so that the tie rod is halfway between the two pressure devices 5 and the two mandrel wheels 3 respectively, the tensile and compression forces arising during operation receiving equally long lever arms and being able to balance out one another.

In the operation of a packing machine comprising the arrangement in accordance with the invention a raised, prefabricated, tubular packing container blank 1 is fed to the container bottom pressing station having passed first, due to the stepwise rotation of the mandrel wheel, the heating station, where the bottom surface or heater 4 has heated the bottom portion of the packing container blank projecting from the mandrel end to such a temperature that the thermoplastic surface layer has attained its sealing temperature. During continued turning or indexing of the mandrel wheel the bottom wall panels of the blank 1 are folded in conventional manner in the crease lines provided so that a substantially flat bottom is produced where the bottom wall panels partly overlap one another and can be sealed in a liquid-tight manner. The sealing is carried out in that the pressure plate 27 is moved in the direction towards the end surface of the container carrying mandrel 2, which a moment before, through rotation of the mandrel wheel 3 has been moved to a position axially in line with the pressure device 5. The pressure device 5, at this time, will press together, with a predefined force, determined by the precompressed spring elements 28, the end wall panels partially overlapping one another, so that the still soft thermoplastic material joints the panels to each other in a liquid-tight manner, as a result of which, after cooling, a liquid-tight, substantially plane container bottom is formed.

As soon as a packing container blank 1 with folded-down bottom wall panels has been placed in position under the pressure device 5, the lever arm 18 of the driving shaft 17 is acted upon from a cam linked to the main driving shaft of the machine so that the driving shaft 17 performs a turning movement, at the end of which the groove 24 in the end of the shaft 17 is substantially in a plane which extends through the eccentric shaft as well as the mandrel wheel axle 19. Via the tongue 23 at one end of the eccentric shaft 20 the eccentric shaft 20 is turned a corresponding degree so that the two eccentrics displace the pressure shafts 26, mounted on the eccentrics in the direction towards the mandrel wheel axle 19. During this step, the pressure plates 17 come to rest against the end wall panels folded down over the free end surfaces of the mandrels 2, and those are pressed together with a predefined force determined by the spring elements 28. The pressure shafts 26 have a slightly larger movement than the free space between the end surfaces of the mandrels 2 and the pressure plates 27, and the pressure shafts 26, therefore, move a little further in the direction towards the mandrel wheel axle 19 during continued compression by the spring elements 28. The resistance against movement of the pressure shafts 26 generated at this step permit the pressure shafts 26, via their ends mounted on the eccentrics 25, to slightly lift the eccentric shaft 20 (in the direction from the mandrel wheel axle 19; that is to say upwards in FIG. 3), which is possible owing to the eccentric shaft being mounted in the overhung manner. The tongue 23 of the eccentric shaft will slide upwards a little (FIG. 3) in the groove 24, and at the opposite end of the eccentric shaft the bush 21, in a corresponding manner, will slide upwards a little in the groove provided in the bracket 16. The eccentric shaft 20 is slightly displaced during this operation by (approx. 0.5–1 mm) in the direction from the mandrel wheel axle 19 in the plane which is common for the mandrel wheel axle and the eccentric shaft. Since the tie rod 30 is mounted so that it can rotate on the center portion of the eccentric shaft 20, the tie rod 30 will also be displaced slightly in the same direction. The movement of the tie rod 30 is limited by the play in its bearing surrounding the mandrel wheel axle 19, this play preferably amounting to 0.5–1 mm. As soon as this play has been used up, tensile forces corresponding to the combined compressive forces on the mandrels 2 will arise in the tie rod 30. Since the two ends of the tie rod 30 are mounted halfway between the pressure device 5 and the mandrel wheel 3 respectively, the lever arms of the forces will be equally long and thus cancel each other out, so that any oblique stresses are avoided. Due to this design, the forces which are pressing down of the bottom of the container act upon the two mandrels via the mandrel wheel 3 and are prevented from reaching the mandrel wheel axle 19 and its bearing in the machine frame 15. Instead, with the help of the tie rod 30, an internally balanced play of forces is brought about which does not stress the mandrel wheel axle 19 with its bearing in the machine frame 15, the driving shaft 17 with its bearing or the bracket 16. Hence these components can be dimensioned much smaller, and thereby a cheaper design is achieved with the same or even increased, working life.

Although the present invention has been described herein in the context of its arrangement with a container package handling machine, it will be appreciated that other applications of the present invention are possible. Furthermore, the references to the directions of movements of the various elements are intended as exemplary and not limiting. Thus, although a preferred embodiment is illustrated and described herein, modifications and variations of the present invention are possible in light of the above teachings and with the purview of the appended claims without departing from the spirit and intended scope of the invention.

What is claimed is:

1. An arrangement for application of pressure on a packing machine including an indexable, rotatable mandrel wheel with radial mandrels (2) for positioning packing container blanks to form sealed bottoms of the packing container blanks, comprising a shaft with eccentrically arranged portions, the shaft being connected to pressure devices cooperating with the mandrels and to means connected to the mandrel wheel for absorbing tensile forces.

2. An arrangement in accordance with claim 1, wherein the means for absorbing tensile forces is a tie rod having one end mounted on the eccentric shaft and an opposite end mounted on an axle of the mandrel wheel.

3. An arrangement in accordance with claim 1 wherein on machines with two parallel mandrel wheels the tie rod is arranged between two of the pressure devices.

4. An arrangement in accordance with claim 1 wherein the shaft with eccentric portions is mounted in an overhung manner in the machine frame.

5. An arrangement in accordance with claim 4, wherein the shaft with eccentric portions is displaceable substantially in a plane which connects the axis of rotation of the mandrel wheel with the eccentric shaft.

6. An arrangement in accordance with claim 5, wherein one end of the eccentric shaft is connected to a driving shaft via a flexible coupling with a groove which in an active position is substantially in said plane.

7. An arrangement in accordance with claim 1 wherein the pressure devices comprise a pressure plate connected to the eccentric shaft via precompressed springs.

8. A packing machine for manufacturing packing containers from flexible packing laminate blanks having a gable type top and a substantially flat bottom provided by folding and sealing bottom wall panels comprising, a housing bracket connected to a frame portion of said machine;

an eccentric shaft mounted in said bracket and driven by a driving shaft supported in said machine frame by a bearing arrangement, the eccentric shaft having an eccentric means provided thereon;

a mandrel wheel mounted on a mandrel wheel axle rotatably supported in said machine frame, the mandrel wheel transporting the packing containers to a work station for said sealing of said bottom wall panels;

a tie rod having a first end connected to said eccentric shaft and a second end connected to said mandrel wheel axle;

a pressure device having a first end rotatably mounted on said eccentric means and a second end for contacting and sealing said bottom wall panels when said containers are positioned at said work station; and spring means for biasing apart two portions of said pressure device; whereby said eccentric shaft and said mandrel wheel axle are drivingly interconnected so as to align said pressure device with the packing container transported by the mandrel wheel.

9. The packing machine of claim 8, wherein a first end of said eccentric shaft is rotatably mounted in a bushing rotatably received in said bracket and a second end of said eccentric is connected to the driving shaft by a flexible coupling.

10. The packing machine of claim 8, wherein said pressure device includes a pressure shaft and a pressure plate having a guide element slidably received in said pressure shaft, said spring means biasing said pressure shaft and said pressure plate in opposite directions.

11. The packing machine of claim 9, wherein said flexible coupling includes a tongue element integral with said second end and received in a groove of the driving shaft.

* * * * *